United States Patent [19]

Mitsuhashi

[11] Patent Number: 4,699,865

[45] Date of Patent: Oct. 13, 1987

[54] IMAGE FORMING METHOD

[75] Inventor: Yasuo Mitsuhashi, Yokohama, Japan

[73] Assignee: Canon Kabushiki Kaisha, Tokyo, Japan

[21] Appl. No.: 23,983

[22] Filed: Mar. 11, 1987

Related U.S. Application Data

[63] Continuation of Ser. No. 707,822, Mar. 4, 1985, abandoned.

[30] Foreign Application Priority Data

| | | | |
|---|---|---|---|
| Mar. 9, 1984 | [JP] | Japan | 59-44921 |
| Mar. 14, 1984 | [JP] | Japan | 59-49575 |
| Jun. 20, 1984 | [JP] | Japan | 59-126976 |

[51] Int. Cl.[4] ..... G03G 13/22; G03G 21/00

[52] U.S. Cl. ..... 430/101; 430/102; 430/106.6; 430/111; 430/122; 430/125; 430/126; 430/903

[58] Field of Search ..... 430/101, 102, 106.6, 430/111, 122, 125, 126, 903

[56] References Cited

U.S. PATENT DOCUMENTS

| | | | |
|---|---|---|---|
| 3,850,630 | 11/1974 | Regensburger et al. | 430/58 |
| 4,076,564 | 2/1978 | Fisher | 430/125 X |
| 4,142,981 | 3/1979 | Bean et al. | 430/111 X |
| 4,210,448 | 7/1980 | Forgo | 430/903 X |
| 4,239,845 | 12/1980 | Tanaka et al. | 430/122 |
| 4,331,757 | 5/1982 | Tanaka et al. | 430/111 X |
| 4,362,802 | 12/1982 | Tanaka et al. | 430/903 X |
| 4,482,621 | 11/1984 | Kashiwagi | 430/111 X |
| 4,514,480 | 4/1985 | Wada et al. | 430/122 X |

FOREIGN PATENT DOCUMENTS

| | | | |
|---|---|---|---|
| 58-189646 | 11/1983 | Japan | 430/106.6 |

*Primary Examiner*—Roland E. Martin

*Attorney, Agent, or Firm*—Fitzpatrick, Cella, Herper & Scinto

[57] ABSTRACT

A process for developing a latent image with a developer is provided which comprises (1) forming a layer of a developer comprising a magnetic toner containing magnetic powder having a BET specific surface area of 2 to 20 $m^2/g$ on a member for supporting the developer, (2) bringing an electrophotographic photosensitive member holding the latent image into contact with said developer layer, said electrophotographic photosensitive member comprising an organic photoconductive material having a surface hardness more than 10 g, (3) forming a toner image on said electrophotographic photosensitive member, (4) transferring the toner image onto the transfer material, and (5) cleaning the electrophotographic photosensitive member having passed through the transferring step with a cleaning member. Said developer may alternatively comprises magnetic particles containing a binder and magnetic powder having a BET specific surface area of 2 to 20 $m^2/g$, and a non-magnetic or magnetic toner on a member for supporting the developer.

27 Claims, 1 Drawing Figure

IMAGE FORMING METHOD

This application is a continuation of application Ser. No. 707,822, filed Mar. 4, 1985, now abandoned.

BACKGROUND OF THE INVENTION

1. Field of the Invention

This invention relates to a novel image forming method employing a photosensitive member comprising an organic photoconductive member having a specific surface hardness and a developer utilizing magnetic powder having a specific BET specific surface area.

2. Description of the Prior Art

As the photoconductive material to be used in electrophotographic photosensitive, inorganic materials such as selenium, cadmium sulfide and zinc oxide have been known. These photosensitive members have a number of advantages such as capability of charging to an appropriate potential in the dark, small dissipation of charges in the dark or rapid dissipation of charges by light irradiation. On the other hand, they also possess various drawbacks. For example, in selenium photosensitive members, crystallization will readily occur due to factors such as temperature, humidity, dust, pressure, etc. Particularly, at an atmospheric temperature in excess of 40° C., crystallization will proceed markedly to cause deleterious lowering in charging characteristic or occurrence of white speckles. Also, in a selenium photosensitive member or cadmium sulfide photosensitive member, there is involved the drawback that no stable sensitivity and durability can be obtained in prolonged usage under humid conditions.

On the other hand, a zinc oxide photosensitive member requires a sensitizing effect with a sensitizing dye, typically Rose Bengal. Since such a sensitizing dye will suffer deterioration by corona charging or color fading by exposed light, there is a drawback in that no stable image can be given over a long term.

Various organic photoconductive polymers, typically polyvinylcarbazole, have also been proposed, but these polymers, while they are superior to those inorganic photoconductive materials as mentioned above with respect to film forming property, light weight, high productivity, etc., could hitherto hardly been practically applied, because they are inferior to inorganic photoconductive members with respect to sensitivity, durability characteristics and stability to environmental changes. Moreover, no appropriate sensitizer capable of sensitizing sufficiently the organic photosensitive member has yet been found.

For the reasons as mentioned above, a number of developments have also been made in recent years in low molecular weight organic photoconductive materials in place of polymeric organic photoconductive materials. The advantage of low molecular weight organic photoconductive materials resides in broadened scope of suitable compounds, which enables choice of compounds having high sensitivity and charge retentivity, whereby the drawbacks of the photosensitive member caused by use of the organic photoconductive polymer of the prior art can be removed.

The photosensitive member comprising an organic photoconductive material (hereinafter abbreviated as OPC) has the drawback that it has a low surface hardness and hence is susceptible to scratches. For this reason, the surface of the photosensitive member cannot be cleaned strongly and therefore the low resistance materials formed on the photosensitive member surface by corona charging, etc., paper powder attached on the surface or other low resistance materials formed by other causes are difficult to remove. In particular, under high temperature and high humidity conditions, the aforesaid materials will absorb moisture until resistance is extremely lowered to disadvantageously disturb latent images.

As the result of various investigations on the method to overcome such drawbacks of OPC photosensitive members, it has now been found that it is effective to bring a magnetic toner or magnetic particles containing specific magnetic powder into contact with an OPC photosensitive member.

A novel developing method has previously been proposed in Japanese Laid-open Patent Publication No. 43036/1979. This method comprises thinly applying a magnetic toner onto a sleeve, subjecting this to triboelectric charging, then effecting development by bringing this toner under the action of a magnetic field to confront the electrostatic image without contact. According to this method, excellent images can be obtained because of such reasons that sufficient triboelectric charging is rendered possible by thinly applying the magnetic toner on the sleeve thereby increasing the chances of contact between the sleeve and the toner, that the toner is supported by magnetic force, and the magnet and the toner are moved relative to each other whereby mutual agglomeration between toner particles is disintegrated and also sufficient friction with the sleeve is attained, and that ground fog is prevented by supporting the toner by magnetic force and performing development while bringing the toner closely face to face to the electrostatic image without contact. However, according to this method, in spite of the use of a magnetic toner, the above-mentioned disturbance of the latent image could hardly be cancelled, when it is applied for an OPC photosensitive member.

SUMMARY OF THE INVENTION

An object of the present invention is to provide an image forming method which has overcome the drawbacks as mentioned above and is free from occurrence of disturbance of latent images even under high temperature and high humidity environments.

According to one aspect of the present invention, there is provided a process for developing a latent image with a developer comprising:

forming a layer of a developer comprising a magnetic toner containing magnetic powder having a BET specific surface area of 2 to 20 $m^2/g$ on a member for supporting the developer, bringing an electrophotographic photosensitive member holding the latent image into contact with said developer layer, said electrophotographic photosensitive member comprising an organic photoconductive material having a surface hardness more than 10 g, forming a toner image on said electrophotographic photosensitive member, transferring the toner image onto the transfer material, and cleaning the electrophotographic photosensitive member having passed through the transferring step with a cleaning member.

According to another aspect of the present invention, there is provided a process for developing a latent image with a developer comprising:

forming a layer of a developer comprising magnetic particles containing magnetic powder having a BET specific surface area of 2 to 20 $m^2/g$ and a binder, and a non-magnetic or magnetic toner on a member for supporting the developer, bringing an electrophotographic photosensitive member holding the latent image into contact with said developer layer, said electrophotographic photosensitive member comprising an organic photoconductive material having a surface hardness more than 10 g, forming a toner image on said electrophotographic photosensitive member, transferring the toner image onto the transfer material, and cleaning the electrophotographic photosensitive member having passed through the transferring step with a cleaning member.

The reason why the present invention can overcome the drawback of tendency of forming disturbance of the latent image in the OPC photosensitive member may be speculated to be ascribable to the contact of magnetic powder with the OPC photosensitive member.

DETAILED DESCRIPTION OF THE INVENTION

Figure 1:
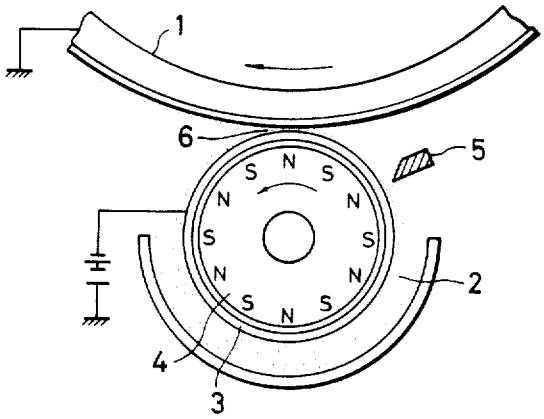
FIG. 1 is a schematic sectional view for illustration of an embodiment of the developing device for carrying out the image forming method of the present invention.

One of the specific features of the method of the present invention resides in bringing a layer of a developer comprising a magnetic toner containing magnetic powder having a specific surface area of 2 to 20 $m^2/g$ as measured by the nitrogen adsorption BET method, a layer of a develper comprising magnetic particles containing said magnetic powder and a magnetic toner, or a layer of a developer comprising said magnetic particles containing said magnetic powder and a non-magnetic toner into contact with an OPC photosensitive member having a surface hardness having a value of 10 g or more.

The organic photoconductive members to be used in the present invention include those in which organic photoconductive polymers such as polyvinylcarbazole are used and those in which low molecular weight organic photoconductive materials and insulating polymers as the binder are employed. Among them, lamination type photosensitive members comprising a charge transport layer and a charge generation layer may preferably used in the present invention. The charge generation layer is formed by dispersing a charge generation material, for example, an azo pigment such as Sudan red, Dian blue, Dienus green B, etc., a quinone pigment such as Algol yellow, Pyrene quinone, Indanthrene brilliant violet RRP, etc., quinocyanine pigment, perylene pigment, indigo pigment such as indigo, thioindigo, etc., bisbenzimidazole pigment such as Indian fast orange toner, etc., phthalocyanine pigment such as copper phthalocyanine, etc., quinacridone pigment and others, in a binder resin such as polyester, polystyrene, polyvinyl-butyral, polyvinyl-pyrrolidone, methyl cellulose, polyacrylic ester, cellulose ester, etc. Its thickness may be 0.01 to 1$\mu$, preferably 0.05 to 0.5$\mu$.

The charge transport layer is formed by dissolving a positive hole transporting material, including compounds having in the main chain or the side chain polycyclic aromatic compounds such as anthracene, pyrene, phenanthrene, coronene, etc., nitrogen containing cyclic compound such as indole, carbazole, oxazole, isoxazole, thiazole, imidazole, pyrazole, oxadiazole, pyrazoline, thiadiazole, triazole, etc., hydrazone compounds, etc., in a resin having film forming property. This is because charge transporting materials have generally low molecular weights and have themselves poor in film forming property. Such resins may include polycarbonate, polymethacrylic esters, polyallylate, polystyrene, polyester, polysulfone, styrene-acrylonitrile copolymer, styrene-methyl methacryalte copolymer and the like. The charge transport layer should preferably have a thickness of 5 to 20$\mu$. In the resin for constituting the surface layer of a photosensitive member such as the charge transport layer, such properties as abrasion resistance or lubricant property are also important. However, such a resin is particularly desired, in the sense to accomplish effectively the objects of the present invention, to have a glass transition temperature (Tg) of 60° C. or higher, particularly 80° C. or higher, at the peak position measured by differential scanning calorimater (DSC).

The surface hardness of the OPC photosensitive member to be used in the present invention should preferably be 10 g or more, particularly 12 to 100 g, as measured by the method as described below.

An OPC photosensitive member is fixed on the sample stand of, for example, HEIDON 14 MODEL surface measuring instrument (produced by Shinto Kagaku) and the sample stand is moved at a speed of 50 mm/min. under a vertical load (x g) applied with a diamond needle (conically shaped, with a conical angle of 90°, with the tip being shaped in a semisphere of 0.01 mm in diameter) to scratch the OPC photosensitive surface. The width of the scratch is measured by, for example, a microscope annexed to the micro-hardness tester MVK-F (produced by Akashi Seisakusho).

The above operation is repeated by changing the load x as, for example, 10 g, 15 g, 20 g, 25 g, 30 g, 35 g, 40 g, etc., and the load for giving a scratch of 50$\mu$ is calculated from the linear regression relationship between the scratch width (arithmetic mean values of the maximum scratch width and the minimum scratch width) and the load, and the value of the load is defined as the hardness of the OPC photosensitive member. When the OPC photosensitive member is a drum, the OPC photosensitive member is set on the sample stand so that scratch may not be formed in the axis direction of the drum.

As the binder for the charge transport layer, a vinyl polymer may be used alone or as a mixture with other resins. Similarly, polycarbonate resin may be used either alone or as a mixture with other resins. Vinyl polymers include homopolymers of vinyl monomers and copolymers of two or more vinyl monomers, including styrene, p-chlorostyrene, vinyltoluene, methyl methacrylate, acrylonitrile, N-vinylcarbazole, etc. Further, copolymers of vinyl monomers with monomers copolymerizable with vinyl monomers such as diene monomers may also be available.

The binder resin for the toner to be used in the present invention may include homopolymers of styrene and derivatives thereof such as polystyrene, poly-p-chlorostyrene, polyvinyltoluene; styrene type copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer; styrene-α-chloromethyl methacrylate, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer, etc.; polymethyl methacrylate, polybutyl methacrylate, polyvinyl chloride, polyvinyl acetate, polyethylene, polypropylene, polyester, polyurethane, polyamide, epoxy resin, polyvinylbutyral, polyacrylic acid resin, rosin, modified rosin, terpene resin, phenol resin, aliphatic or alicyclic hydrocarbon resin, aromatic petroleum resin, chlorinated paraffin, paraffin wax, carnauba wax, etc. These binder resins may be used either singly or as a mixture.

In the present invention, when one component developer is used, a magnetic toner containing magnetic powder is used. The magnetic powder to be incorporated in the magnetic toner to be used in the present invention may be a material which is magnetized when placed in a magnetic field, including powder of a ferromagnetic metal such as iron, cobalt or nickel, or alloys thereof, or compounds such as magnetite, or $\gamma$-$Fe_2O_3$, ferrite.

Particularly, in order that the desired effect is exhibited, the magnetic powder should have a BET specific surface area as measured by the nitrogen adsorption method of 2 to 20 $m^2/g$, preferably 2.5 to 12 $m^2/g$. The content of the magnetic toner should preferably be 10 to 70 wt. % based on the toner weight. The magnetic toner to be used in the present invention should preferably have a volume average particle size of 5 to 20μ, particularly 6 to 15μ.

In the present invention, when two-component developer is to be employed, a developer comprising a non-magnetic toner or a magnetic toner and magnetic particles is used.

The magnetic particles to be used in the present invention comprise magnetic powder and a binder. The magnetic particles should preferably be constituted so as to have triboelectric charges opposite in polarity to those of the toner. The magnetic powder may be a material which is magnetized when placed in a magnetic field, including powder of a ferromagnetic metal such as iron, cobalt or nickel, or alloys thereof, or compounds such as magnetite, or $\gamma$-$Fe_2O_3$, ferrite. These magnetic powders should preferably be treated with an organic compound such as the coupling treatment, etc. Particularly, in order that the effect as mentioned above may be exhibited, the magnetic powder should have a BET specific surface area as measured by the nitrogen adsorption method of 2 to 20 $m^2/g$, preferably 2.5 to 12 $m^2/g$. The binder may be any of thermoplastic resins and thermosetting resins well known in the art. The content of the magnetic powder may preferably be 10 to 80 weight %, particularly 30 to 75 weight % based on the weight of magnetic particles. The particle size of the magnetic particles should preferably be about 8 to 50μ, particularly 10 to 30μ, in terms of volume average size. The magnetic particles should preferably have a volume average particle size of about 3-fold or less of that of the toner. The magnetic particles to be used in the present invention may preferably be produced by kneading by heating magnetic powder and a binder and after cooling crushing to a desired particle size. The magnetic particles thus produced are preferred, since they have the binder resin surface and the magnetic powder surface exposed on their surfaces.

The magnetic toner to be used in the two-component developer may be either the same or different from the aforesaid magnetic toner used as the one-component developer. Also, as the non-magnetic toner to be used in the two-component system, there may be employed the binder resin for toner as described in which known colorants are incorporated. The toner may preferably have a volume average particle size of 5 to 20μ, particularly 6 to 15μ.

Further, non-magnetic inorganic fine powder with a BET specific surface area of 0.5 to 500 $m^2/g$, particularly 50 to 400 $m^2/g$ as measured by the nitrogen adsorption method is preferably added to the magnetic toner, the non-magnetic toner or magnetic particles in the developer to be used in the present invention. Particularly, it is preferred to add said non-magnetic inorganic fine powder to the toner. For, by addition of such fine powder, the disturbance of the latent images as previously described will be alleviated. This may be probably because such fine powder has a great specific surface area, whereby the low resistance material attached on the drum as mentioned above can be removed through adsorption or attachement on such fine powder. As such non-magnetic inorganic powder, there may be included powder or fine particles such as of alumina, titanium dioxide, barium titanate, magnesium titanate, calcium titanate, strontium titanate, zinc oxide, siliceous sand, clay, mica, wollastonite, diatomaceous earth, various inorganic oxide pigments, chromium oxide, cerium oxide, red iron oxide, antimony trioxide, magnesium oxide, zirconium oxide, barium sulfate, barium carbonate, calcium carbonate and silica. Particularly, fine silica particles are preferred.

The fine silica particles as herein mentioned refers to fine particles having Si—O—Si bondings, including both of those produced according to the dry process and those produced according to the wet process. Various known processes are applicable as the wet process. For example, there may be included the method according to decomposition of sodium silicate with an acid as generally shown by the following reaction scheme:

$$Na_2O \cdot \times SiO_2 + HCl + H_2O \rightarrow SiO.nH_2O + NaCl$$

or otherwise according to decomposition of sodium silicate with an ammonium salt or an alkali salt (hereinafter the reaction scheme is abbreviated); the method wherein an alkaline earth metal silicate is formed from sodium silicate, followed by decomposition with an acid, to form silicic acid; the method wherein a sodium solicate solution is converted with an ion-exchange resin into silicic acid; or the method in which natural silicic acid or silicate is utilized.

For the fine silica particles herein mentioned, anhydrous silicon dioxide (silica) or otherwise any of silicates such as aluminum silicate, sodium silicate, potassium silicate, magnesium silicate, zinc silicate and the like may be applicable. Its particle size should desirably be within the range of from 0.01 to 2μ as the primary particle size. Also, those containing 85 weight % or more of $SiO_2$ are preferred.

The fine silica particles according to the dry process are the so-called dry process silica or fumed silica, which can be produced according to conventional techniques known in the art. For example, it is a process which utilizes the pyrolytic oxidation reaction in oxygen-hydrogen flame of silicon tetrachloride gas, and the basic reaction scheme may be represented as follows:

$$SiCl_4 + 2H_2 + O_2 \rightarrow SiO_2 + 4HCl.$$

Also, in this preparation step, it is possible to obtain a composite fine powder of silica with metal oxides by use of other metal halides such as aluminum chlordie or titanium chloride together with the silicon halides, and such embodiments are also included within the present invention.

Their particle sizes, in terms of average primary particle size, may desirably be within the range of from 0.001 to 2μ, particularly preferably from 0.002 to 0.2μ.

Typical examples of these fine silica particles may include various commercially available silicas, preferably those having hydrophobic groups on the surface, as exemplified by R-972 (produced by Aerosil Co.), Taranox 500 (produced by Talco Co.), and otherwise those treated with silane coupling agents, titanium coupling agents, silicone oils and silicone oils having amines in the side chains, etc. Particularly, when the magnetic toner is a toner for development of negative latent images, it is preferred to employ positively chargeable fine silica particles. Further, said positively chargeable fine silica particles may preferably have triboelectric charges of +10 μc/g or more, particularly preferably +30 μc/g or more as measured by the method as described below.

Here, the positively chargeable fine silica particles are defined as follows. That is, 2 g of fine silica particles left to stand overnight under the environment of 25° C. and 50–60% and 98 g of carrier iron powder not coated with a resin having a primary particle size at 200–300 mesh (e.g. EFV 200/300, produced by Nippon Teppun Co.) are thoroughly blended (manually shaken, vertically for about 50 strokes) in an aluminum pot, and triboelectric charges of fine silica particles are measured according to the conventional blow-off method by use of an aluminum cell having a 400 mesh screen. The fine silica particles having positive triboelectric charges as measured by this method are defined as positively chargeable fine silica particles.

For obtaining such positively chargeable fine silica particles, it is preferred to apply treatment with a coupling agent or a silicone oil having amines. Examples of such treating agent may include aminosilane coupling agents:

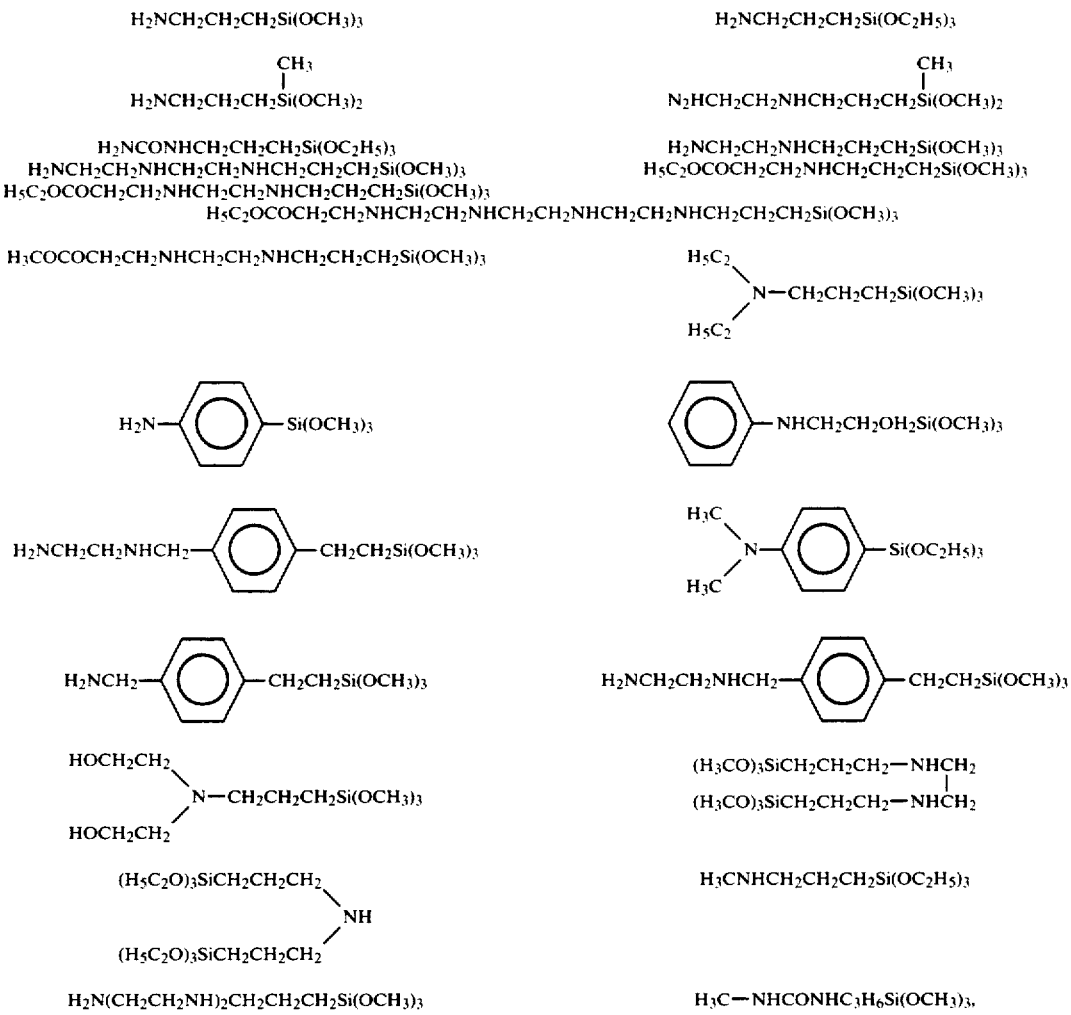

modified silicon oils having amines in the side chains represented by the following formula:

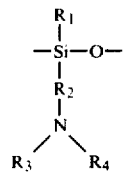

(wherein $R_1$ represents hydrogen, an alkyl group, aryl group or an alkoxy group, $R_2$ represents an alkylene group or phenylene group, and $R_3$ and $R_4$ represent hydrogen, an alkyl group or an aryl group, with proviso that the above alkyl group, aryl group, alkylene group or phenylene group may have amines or substituents such as halogens within the range which does not impair the charging characteristic).

Such silicone oils include, for example, the following commercial products:

| | Trade Name | Viscosity at 25° C. (cps) | Amine equivalent |
|---|---|---|---|
| SF8417 | (produced by Toray Silicone Co.) | 1200 | 3500 |
| KF393 | (produced by Shinetsu Kagaku Co.) | 60 | 360 |
| KF857 | (produced by Shinetsu Kagaku Co.) | 70 | 830 |
| KF860 | (produced by Shinetsu Kagaku Co.) | 250 | 7600 |
| KF861 | (produced by Shinetsu Kagaku Co.) | 3500 | 2000 |
| KF862 | (produced by Shinetsu Kagaku Co.) | 750 | 1900 |
| KF864 | (produced by Shinetsu Kagaku Co.) | 1700 | 3800 |
| KF865 | (produced by Shinetsu Kagaku Co.) | 90 | 4400 |
| KF369 | (produced by Shinetsu Kagaku Co.) | 20 | 320 |
| KF383 | (produced by Shinetsu Kagaku Co.) | 20 | 320 |
| X-22-3680 | (produced by Shinetsu Kagaku Co.) | 90 | 8800 |
| X-22-380D | (produced by Shinetsu Kagaku Co.) | 2300 | 3800 |
| X-22-3801C | (produced by Shinetsu Kagaku Co.) | 3500 | 3800 |
| X-22-3810B | (produced by Shinetsu Kagaku Co.) | 1300 | 1700 |

The amine equivalent as herein mentioned refers to the equivalent amount per one amine (g/equiv), which is the value obtained by dividing the molecular weight by number of amines per one molecule.

Preferable fine silica particles are those exhibiting a hydrophobicity value as measured by the methanol titration method within the range of from 30 to 80. For such hydrophobic treatment, there may be employed the hydrophobic modification method known in the art, and hydrophobicity can be imparted by treatment with an organic silicon compound capable of reaction with or physical adsorption onto fine silica particles. As a preferable method, after or simultaneously with treatment of fine silica particles with a silane coupling agent, etc. as described above, fine silica particles are treated with an organic silicon compound.

Examples of such organic silicon compounds are hexamethyl disilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilyl acrylate, vinyldimethylacetoxysilane, and further, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane and dimethylpolysiloxanes having 2 to 12 siloxane units per molecule and containing each one hydroxy group bonded to Si at the terminal units and the like. They may be used singly or as a mixture of two or more compounds.

Here, the methanol titration test is an experimental test for confirmation of the extent of hydrophobicity of the fine silica particles having surfaces subjected to hydrophobic treatment.

The "methanol titration test" defined in the present specification is conducted as follows for evaluation of hydrophobicity of the treated fine silica particles. A sample of fine silica particles in an amount of 0.2 g are charged into 50 ml of water in a 250 ml Erlenmeyer flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol at the end point.

The amount of the fine silica particles to be applied in the present invention may be 0.01 to 20% to exhibit the effect, particularly preferably 0.1 to 3%, whereby positive charging characteristic having excellent stability can be exhibited. To describe about the preferable mode in which they are added, it is desirable that 0.01 to 3 weight % based on the weight of the developer of the treated fine silica particles should be adhered onto the toner particle surfaces.

As the colorant to be used for the toner of the present invention, there may be employed those known in the art such as carbon black, copper phthalocyanine, iron black, red iron oxide, $\gamma$-$Fe_2O_3$, etc., and the charge controllers known in the art may be available for the present invention. For example, there may be employed benzyldimethylhexadecylammonium chloride, decyltrimethylammonium chloride, nigrosine, safranine $\gamma$ and crystal violet, metal complexes, etc.

Further, the developer of the present invention may also contain, if necessary, lubricants, electroconductivity imparting agents, fixing agents, such as polytetrafluoroethylene powder, polyvinylidene fluoride powder, metal salts of higher fatty acids, carbon black, electroconductive tin oxide, low molecular weight polyethylene, low molecular weight polypropylene, etc.

Further, the magnetic toner of the present invention may preferably have a volume resistivity of $10^{10}$ ohm·cm or more, particularly $10^{12}$ ohm·cm or more. The volume resistivity as herein mentioned is defined as the value calculated form the current value when measured one minute after application of an electrical field of 100 V/cm on a compression molded toner molded under a pressure of 100 Kg/cm$^2$.

The content of magnetic particles when employing a two-component developer is employed, in order to maintain developing characteristic of the toner, may be 1 to 95 weight %, preferably 5 to 90 wt. %, particularly 10 to 75 weight %. Further, the binder to be used for both the toner and magnetic particles may preferably contain 30 weight % or more of the constituent unit of styrene component for the purpose of accomplishing the object of the present invention as well as obtaining good images.

In the present invention, there may be employed the method in which the developer layer is caused to contact an OPC photosensitive member. It may be considered that the magnetic powder in the magnetic toner or the magnetic particles scrapes the surface of the photosensitive member to remove the adherants on the surface of the photosensitive member simultaneously with grinding of the surface of the photosensitive member. Accordingly, the relationship between the content of magnetic powder in the magnetic toner or magnetic particles [W (weight %)] and the hardness of the surface of the photosensitive member [H (gram)] is important. If the content of magnetic powder is too small, the above effect can be accomplished with difficulty, while too much an amount will liable to damage the photosensitive member at the developing section and/or the cleaning section. The relationship between the content of magnetic powder [W (weight %)] and the hardness of the photosensitive member surface [H (gram)] may preferably satisfy the formula: $0.2 < W/H < 6.0$, particularly the formula: $0.5 < W/H < 5.0$.

Further, for grinding more uniformly the photosensitive member surface, the BET specific surface area [S ($m^2$/gram)] is also important. If the BET specific surface area of magnetic powder is too large, the aforesaid effect can be accomplished with difficulty. If the BET specific surface area of magnetic powder is too small, it will readily damage the photosensitive member surface. The relationship between the BET specific surface area of magnetic powder and the hardness of the photosensitive member surface may preferably satisfy the formula: $30 < S \cdot H < 600$, particularly the formula: $40 < S \cdot H < 360$.

An example of the developing device to be used in the present invention is shown in the accompanying drawing. In this FIGURE, by rotating at least one of the sleeve 3 or the multi-pole magnet 4, the developer 2 is delivered in the direction of the arrow, and the developer is regulated by the blade 5 to form the developer layer 6. The developer layer 6 formed on the sleever 3 is set so as to contact the photosensitive member 1 at the developing section. A bias voltage may also be applied between the sleeve and the photosensitive member 1.

As the transfer method to be used in the present invention, there may be employed the methods which have been well known in the art, including the electrostatic transfer system, the bias roll system, the pressure transfer system, the magnetic transfer system, etc. Further, as the method for cleaning residual toner on the photosensitive member, there may be employed those well known in the art, such as the blade cleaning system, the fur blush cleaning system, the magnetic brush cleaning system, etc. Immediately before the cleaning step, deelectrification step, etc. may also be provided, if necessary, for the purpose of making toner cleaning easier. The operation to polish the photosensitive surface with magnetic particles or magnetic toner is performed primarily in the developing step and the cleaning step. For performing effectively polishing, in the image forming method of the present invention, it is preferred for accomplishing the objects effectively to employ the blade cleaning system as an excellent combination of the developer of the present invention and the photosensitive member.

When the blade cleaning system is employed, the pressure at which the blade is pressed against the photosensitive member under static state may preferably be 1 to 100 g/cm, particularly 4 to 50 g/cm, in terms of the load applied on the photosensitive member per unit length of the blade. At a pressure less than 1 g/cm, insufficient cleaning may occur, while a pressure over 100 g/cm will readily damage the photosensitive member. The load applied on the photosensitive member per blade unit length may be calculated from the modulus and the shape of the material used for the blade, the amount of displacement of the tip of the blade when pressed against the photosensitive member from the tip (the portion at which the blade contacts the photosensitive member when pressed thereagainst) of the blade under non-loaded state. Further, the blade should preferably made of a polyurethane rubber, partiuclarly a blade employing a polyurethane rubber having a hardness of 50 to 90 in terms of A rubber hardness according to JIS.

Example 1

A mixture of 100 parts by weight of a copolymer of styrene-butyl methacrylate-dimethylaminoethyl methacrylate (weight ratio: 7:2.5:0.5 molecular weight($\overline{M}w$)=220,000), 80 parts by weight of Magnetite with a BET specific area of 5 $m^2$/g and 3 parts by weight of a polyethylene wax was kneaded by melting on a roll mill. After cooling, the kneaded mixture was crushed coarsely by a hammer mill, followed by micropulverization by means of a jet crushing machine. The the particles were classified by a wind force classifier to obtain black powder with particle sizes of about 5 to 20$\mu$.

On the other hand, while stirring 100 parts by weight of fine silica particles (specific surface area: about 130 $m^2$/g) synthesized according to the dry process, 12 parts by weight of a silicone oil having amines in the side chains (viscosity at 25° C.: 70 cps, amine equivalent: 830) were sprayed thereon, and the treatment was carried out by maintaining at a temperature of about 250° C. for 60 minutes. The treated silica formed was found to have triboelectric charges of +130 $\mu$c/g.

To 100 parts by weight of the above black fine particles as prepared above were added 0.4 part by weight of the above fine silica particles treated with a silicone oil having amines in the side chains to provide a toner. The toner was found to have a volume resistivity of $10^{14}$ ohm.cm.

On the other hand, a lamination type OPC photosensitive member having a charge transport layer comprising a methyl methacrylate-styrene copolymer (weight ratio: 9:1) having a Tg of 80° C. or higher as measured by DSC was prepared on an electroconductive cylinder to obtain a photosensitive drum. The surface of the photosensitive member had a hardness of 21 g according to the measurement method as described above. In the charge transport layer, a compound shown below was used as the charge transport agent:

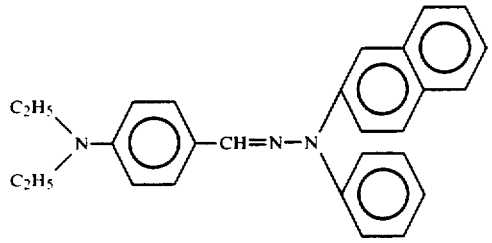

and 100 parts of methyl methacrylate-styrene are met are mixed per 100 parts by weight of the charge transport agent. In the charge generation layer, $\beta$-type copper phthalocyanine is employed as the charge generation agent, and the charge generation layer was formed by mixing 50 parts by weight of polyvinyl-butyral with 100 parts by weight of the charge generation agent. As the subbing layer, a polyamide was employed. The photosensitive member is formed of an electroconductive cylinder, a subbing layer, a charge generation layer and a charge transport layer.

The photosensitive drum was charged by corona charging at $-6$ KV uniformly at a line surface speed of 66 mm/sec., followed by irradiation of the original image, to form a latent image. The latent image was developed by setting the sleeve-rotary magnet rotary type developing instrument with a sleeve diameter of 50 mm, a sleeve surface magnetic flux density of 700 Gauss, a number of magnetic poles of 12 and a blade-sleeve distance of 0.4 mm, as shown in FIG. 1, at a distance of 0.3 mm between the photosensitive drum surface and the sleeve surface, applying a direct current bias voltage of $-100$ V on the sleeve surface and causing the toner layer formed by use of the above toner on the sleeve to contact the photosensitive drum, and then transferred the powder image while irradiating corona of $-7$ KV from the back of the transfer paper, followed by fixing by heated rolls. Clear images were obtained. The residual toner on the photosensitive member was removed by a blade made of polyurethane (hardness 65°). When running test was conducted for 3000 sheets under high temperature and high humidity conditions (32° C., 90%), good images could be obtained without disturbance of the images.

COMPARATIVE EXAMPLE 1

The experiment was conducted in substantially the same manner as in Example 1 except that the magnetic toner layer on the sleeve was set so as not to contact the OPC photosensitive drum. As the result of running test under high temperature and high humidity conditions, marked disturbance of images occurred.

EXAMPLE 2

When Example 1 was repeated except that a styrene-acrylonitrile copolymer (weight ratio 7:3, molecular weight ($\overline{M}w$) = 250,000) having a Tg of 80° C. or higher was employed as the binder in the charge transport layer in place of the methyl methacrylate-styrene copolymer of Example 1, good results were obtained. The hardness of the photosensitive hardness was found to be 15 g.

EXAMPLE 3

In place of the fine silica particles of Example 1, fine silicic acid particles (triboelectric charges: $+160$ $\mu$c/g) formed by treating fine silica particles synthesized by the dry process (specific surface area: about 200 $m^2/g$) with 5% aminopropyltriethoxysilane and 15% of amino-modified silicone oil (viscosity 750 cps, amine equivalent: 1900) were employed, following otherwise substantially the same procedure as in Example 1. Good results were obtained. The toner had a volume resistivity of $10^{14}$ ohm.cm.

EXAMPLE 4

Example 1 was repeated except that a polymethyl methacrylate (molecular weight ($\overline{m}w$) = 1,000,000) having a Tg of 80° C. or higher was employed as the binder in the charge transport layer in place of the methyl methacrylate-styrene copolymer of Example 1. Good results were obtained. The surface of the photosensitive member had a hardness of 26 g.

EXAMPLE 5

Magnetite was replaced with 90 parts by weight of $\gamma$-$Fe_2O_3$ with a BET specific surface area of 6 $m^2/g$, following otherwise the same procedure as in Example 1. As the result good images without disturbance could be obtained. The toner had a volume resistivity of $10^{15}$ ohm.cm.

EXAMPLES 6,7

According to substantially the same procedure as in Example 1, except for using Magnetites with BET specific surface areas of 3 $m^2/g$ and 10 $m^2/g$ and treated on the surface with titanium coupling agent TTS, experiments were repeated. Good results were obtained. The Magnetite in Example 6 contains 1 weight % TTS, and the Magnetite in Example 7 contains 3 weight % TTS.

EXAMPLE 8

Except for using a toner in which 0.6% of an electroconductive tin oxide with a BET specific surface area of 55 $m^2/g$ was further added, Example 1 was repeated to obtain good results.

EXAMPLE 9

An experiment was performed according to substantially the same procedure as in Example 1 except for employing fine silica particles synthesized by the wet process with a BET specific surface area of 85 $m^2/g$ treated with vinyl ethoxy silane (containing 3 weight % vinyltriethoxysilane; triboelectric charges: $-29.0$ $\mu$c/g) in place of the treated silica of Example 1. Clear images were obtained. When running test was conducted for 3000 sheets under high temperature and high humidity, good images without disturbance of image could be obtained.

EXAMPLE 10

Example 9 was repeated except that treatment was conducted by use of dimethyl silicone oil in place of vinyl triethoxy silane. Good results could be obtained. The silica treated with dimethyl silicone oil was found to have triboelectric charges of $-33$ $\mu$c/g.

EXAMPLE 11

Example 9 was repeated except that the silica subjected to no treatment was employed. The silica was found to have triboelectric charges of $-30$ $\mu$c/g. Good results were obtained.

EXAMPLE 12

A mixture of 100 parts by weight of a copolymer of styrene-butyl methacrylate-dimethylaminoethyl methacrylate (weight ratio 7:2.5:0.5, molecular weight ($\overline{M}w$)=220,000), 40 parts by weight of Magnetite with a BET specific area of 5 $m^2/g$ and 3 parts by weight of a polyethylene wax was kneaded by melting on a roll mill. After cooling, the kneaded mixture was crushed coarsely by a hammer mill, followed by micropulverization by means of a jet crushing machine. The particles were classified by a wind force classifier to obtain black powder with a volume average particle size of about 13$\mu$.

on the other hand, while stirring 100 parts by weight of fine silica particles (specific surface area: about 130 $m^2/g$) synthesized according to the dry process, 12 parts by weight of a silicone oil having amines in the side chains (viscosity at 25° C.: 70 cps, amine equivalent: 830) were sprayed thereon, and the treatment was carried out by maintaining at a temperature of about 250° C. for 60 minutes. The treated silica formed was found to have triboelectric charges of +130 $\mu c/g$.

To 100 parts by weight of the above black fine particles as prepared above were added 0.4 part by weight of the above fine silica particles treated with a silicone oil having amines in the side chains to provide a toner. The toner was found to have a volume resistivity of $10^{15}$ ohm.cm.

Also, magnetic particles comprising 100 parts by weight of a styrene-methyl methacrylate-butyl maleate copolymer (weight ratio: 8:1.5:0.5, molecular weight ($\overline{M}w$)=250,000), 200 parts by weight of Magnetite (BET specific surface area 4 $m^2/g$) and 5 parts by weight of carbon black were prepared. The particles had a volume average particle size of 20$\mu$. The above toner and the magnetic particles were mixed at a weight ratio of 60:40 to prepare a developer.

On the other hand, a lamination type OPC photosensitive member having a charge transport layer comprising a methyl methacrylate-styrene copolymer (weight ratio: 9:1) having a Tg of 80° C. or higher as measured by DSC was prepared on an electroconductive cylinder to obtain a photosensitive drum. The surface of the photosensitive member had a hardness of 21 g according to the measurement method as described above. In the charge transport layer, a compound shown below was used as the charge transport agent:

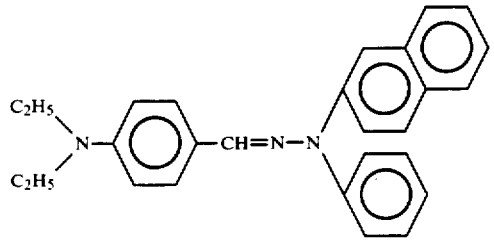

and 100 parts of methyl methacrylate-styrene are mixed per 100 parts by weight of the charge transport agent. In the charge generation layer, $\beta$-type copper phthalocyanine is employed as the charge generation agent, and the charge generation layer was formed by mixing 50 parts by weight of polyvinylbutyral with 100 parts by weight of the charge generation agent. As the subbing layer, a polyamide was employed. The photosensitive member is formed of an electroconductive cylinder, a subbing layer, a charge generation layer and a charge transport layer.

The photosensitive drum was charged by corona charging at −6 KV uniformly at a line surface speed of 66 mm/sec., followed by irradiation of the original image, to form a latent image. The latent image was developed by setting the sleeve-rotary magnet-rotary type developing instrument with a sleeve diameter of 50 mm, a sleeve surface magnetic flux density of 700 Gauss, a number of magnetic poles of 12 and a blade-sleeve distance of 0.5 mm, as shown in FIG. 1, at a distance of 0.4 mm between the photosensitive drum surface and the sleeve surface, applying a direct current bias voltage of −100 V on the sleeve surface and causing the toner layer formed by use of the above toner on the sleeve to contact the photosensitive drum, and then transferred the powder image while irradiating corona of −7 KV from the back of the transfer paper, followed by fixing by heated rolls. The residual toner on the photosensitive member was removed by a blade made of polyurethane (hardness 65° ). Clear images were obtained. When running test was conducted for 3000 sheets under high temperature and high humidity conditions (32° C., 90%), good images could be obtained without disturbance of the images.

COMPARATIVE EXAMPLE 2

The experiment was conducted in substantially the same manner as in Example 12 except for setting such that the magnetic toner layer on the sleeve may not contact the OPC photosensitive drum. As the result of running test under high temperature and high humidity conditions, marked disturbance of images occurred.

EXAMPLE 13

When Example 12 was repeated except that a styrene-acrylonitrile copolymer (weight ratio: 7:3, molecular weight ($\overline{M}w$)=250,000) having a Tg of 80° C. or higher was employed as the binder in the charge transport layer in place of the methyl methacrylate-styrene copolymer of Example 12, good results were obtained. The hardness of the photosensitive hardness was found to be 15 g.

EXAMPLE 14

In place of the fine silica particles of Example 12, fine silicic acid particles (triboelectric charges: +160 $\mu c/g$) formed by treating fine silica particles synthesized by the dry process (specific surface area: about 200 $m^2/g$) with 5% aminopropyltriethoxysilane and 15% of amino-modified silicone oil (viscosity 750 cps, amine equivalent: 1900) were employed, following otherwise substantially the same procedure as in Example 12. Good results were obtained. The toner had a volume resistivity of $10^{15}$ ohm. cm.

EXAMPLE 15

Example 12 was repeated except that a polymethyl methacrylate (molecular weight ($\overline{M}w$)=1,000,000) having a Tg of 80° C. or higher was employed as the binder in the charge transport layer in place of the methyl methacrylate-styrene copolymer of Example 12. Good results were obtained. The surface of the photosensitive member had a hardness of 26 g.

EXAMPLE 16

Magnetite was replaced with 35 parts by weight of $\gamma$-$Fe_2O_3$ with a BET specific surface area of 6 $m^2/g$, following otherwise the same procedure as in Example 12. As the result good images without disturbance could be obtained. The toner had a volume resistivity of $10^{15}$ ohm.cm.

EXAMPLES 17, 18

According to substantially the same procedure as in Example 12, except for using Magnetites with BET specific surface areas of 3 $m^2/g$ and 10 $m^2/g$ and treated on the surface with titanium coupling agent TTS, experiments were repeated. Good results were obtained. The Magnetite in Example 17 contains 1 weight % TTS and the Magnetite in Example 18, 3 weight % TTS.

EXAMPLE 19

Except for using a toner in which 0.6% of an electroconductive tin oxide with a BET specific surface area of 55 $m^2/g$ was further added, Example 12 was repeated to obtain good results.

Further, the same experiment was repeated by use of a photosensitive member comprising a polymeric organic photoconductive member employing polyvinylcarbazole, whereby good results were also obtained.

EXAMPLE 20

An experiment was performed according to substantially the same procedure as in Example 12 except for employing fine silica particles synthesized by the wet process with a BET specific surface area of 95 $m^2/g$ treated with vinyl-ethoxy-silane (triboelectric charges: $-32$ $\mu c/g$) in place of the treated silica of Example 12. Clear images were obtained. When running test was conducted for 3000 sheets under high temperature and high humidity, good images without disturbance of image could be obtained.

EXAMPLE 21

Example 20 was repeated except that treatment was conducted by use of dimethyl silicone oil in place of vinyl-triethoxy-silane. Good results could be obtained. The silica treated with dimethyl silicone oil was found to have triboelectric charges of $-38$ $\mu c/g$.

EXAMPLE 22

Example 20 was repeated except that the silica subjected to no treatment was employed. The silica was found to have triboelectric charges of $-35$ $\mu c/g$. Good results were obtained.

EXAMPLE 23

A mixture of 100 parts by weight of a copolymer of styrene-butyl methacrylate-dimethylaminoethyl methacrylate (weight ratio: 7:2.5:0.5, molecular weight($\overline{M}w$)=220,000), 6 parts by weight of carbon black and 3 parts by weight of a polyethylene wax was kneaded by melting on a roll mill. After cooling, the kneaded mixture was crushed coarsely by a hammer mill, followed by micropulverization by means of a jet crushing machine. The the particles were classified by a wind force classifier to obtain black powder with a volume average particle size of about 13$\mu$.

On the other hand, while stirring 100 parts by weight of fine silica particles (specific surface area: about 130 $m^2/g$) synthesized according to the dry process, 12 parts by weight of a silicone oil having amine in the side chain (viscosity at 25° C.: 70 cps, amine equivalent: 830) were sprayed thereon, and the treatment was carried out by maintaining at a temperature of about 250° C. for 60 minutes. The treated silica formed was found to have triboelectric charges of $+130$ $\mu c/g$.

To 100 parts by weight of the above black fine particles as prepared above were added 0.4 part by weight of the above fine silica particles treated with a silicone oil having amines in the side chains to provide a toner. The toner was found to have a volume resistivity of $10^{15}$ ohm.cm.

Also, magnetic particles comprising 100 parts by weight of a styrene-methyl methacrylate-butyl maleate copolymer (weight ratio: 8:1.5:0.5, molecular weight ($\overline{M}w$)=250,000), 200 parts by weight of Magnetite with a BET specific surface area of 5.6 $m^2/g$ as measured by the nitrogen adsorption method and 5 parts by weight of carbon black were prepared. The particles had a volume average particle size of 18$\mu$. The above toner and the magnetic particles were mixed at a weight ratio of 58:42 to prepare a developer.

On the other hand, a lamination type OPC photosensitive member having a charge transporting layer comprising a methyl methacrylate-styrene copolymer (weight ratio: 9:1) having a Tg of 80° C. or higher as measured by DSC was prepared on an electroconductive cylinder to obtain a photosensitive drum. The surface of the photosensitive member had a hardness of 21 g according to the measurement method as described above. In the charge transport layer, a compound shown below was used as the charge transport agent:

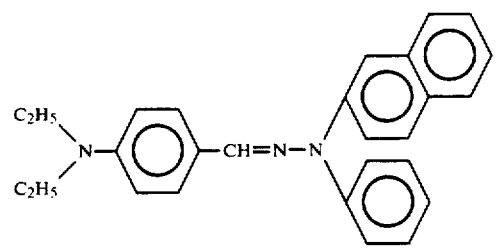

and 100 parts of methyl methacrylate-styrene are mixed per 100 parts by weight of the charge transport agent. In the charge generation layer, $\beta$-type copper phthalocyanine is employed as the charge generation agent, and the charge generation layer was formed by mixing 50 parts by weight of polyvinyl-butyral with 100 parts by weight of the charge generation agent. As the subbing layer, a polyamide was employed. The photosensitive member is formed of an electroconductive cylinder, a subbing layer, a charge generation layer and a charge transport layer.

The photosensitive drum was charged by corona charging at $-6$ KV uniformly at a line surface speed of 66 mm/sec., followed by irradiation of the original image, to form a latent image. The latent image was developed by setting the sleeve-rotary magnet-rotary type developing instrument with a sleeve diameter of 50 mm, a sleeve surface magnetic flux density of 850 Gauss, a number of magnetic poles of 12 and a blade-sleeve distance of 0.6 mm, as shown in FIG. 1, at a distance of 0.5 mm between the photosensitive drum surface and the sleeve surface, applying a direct current bias voltage of $-250$ V on the sleeve surface and causing the toner layer formed by use of the above toner on the sleeve to contact the photosensitive drum, and then transferred the powder image while irradiating corona of −7 KV from the back of the transfer paper, followed by fixing by heated rolls. Clear images were obtained. The residual toner on the photosensitive member was removed by a blade made of polyurethane (hardness 60°). The contact pressure of the blade against the photosensitive member was 15 g/cm. When running test was conducted for 2000 sheets under high temperature and high humidity conditions (32° C., 90%), good images should be obtained without disturbance of the images.

EXAMPLE 24

When Example 23 was repeated except that a styrene-acrylonitrile copolymer (weight ratio: 7:3, molecular weight ($\overline{M}w$)=250,000) having a Tg of 80° C. or higher was employed as the binder in the charge transfer layer in place of the methyl methacrylate-styrene copolymer of Example 23, good results were obtained. The hardness of the photosensitive hardness was found to be 15 g.

EXAMPLE 25

In place of the fine silica particles of Example 23, fine silicic acid particles (triboelectric charges: +160 μc/g) formed by treating fine silica particles synthesized by the dry process (specific surface area: about 200 $m^2/g$) with 5% aminopropyltriethoxysilane and 15% of amino-modified silicone oil (viscosity 750 cps, amine equivalent: 1900) were employed, following otherwise substantially the same procedure as in Example 23. Good results were obtained. The toner had a volume resistivity of $10^{15}$ ohm.cm.

EXAMPLE 26

Example 23 was repeated except that a polymethyl methacrylate (molecular weight($\overline{M}w$)=1,000,000) having a Tg of 80° C. or higher was employed as the binder in the charge transport layer in place of the methyl methacrylate-styrene copolymer of Example 23. Good results were obtained. The surface of the photosensitive member had a hardness of 26 g.

EXAMPLE 27

Magnetite with a BET specific surface area of 5.6 $m^2/g$ was replaced with 150 parts by weight of Magnetite treated with 3% by weight of titanium coupling agent (TTS) with a BET specific surface area of 9.2 $m^2/g$, following otherwise the same procedure as in Example 23. As the result good images without disturbances could be obtained.

EXAMPLE 28

Except for using a toner in which 0.6% of an electroconductive tin oxide with a BET specific surface area of 55 $m^2/g$ was further added, Example 23 was repeated to obtain good results.

EXAMPLE 29

Example 23 was repeated except for using a polycarbonate (molecular weight ($\overline{M}w$)=30,000) with a Tg of 80° C. or higher in place of the methyl methacrylate-styrene copolymer of Example 23. Good results were obtained. The photosensitive member had a surface hardness of 23 g.

EXAMPLE 30

An experiment was performed according to substantially the same procedure as in Example 23 except for adding fine silica particles synthesized by the wet process with a BET specific surface area of 92 $m^2/g$ in place of the treated silica of Example 23. Good results without disturbance of image could be obtained.

EXAMPLE 31

An experiment was performed according to substantially the same procedure as in Example 23 except that a black powder was obtained by use of 100 parts by weight of a styrene-butyl methacrylate (7:3) copolymer, 7 parts by weight of carbon black, 2 parts by weight of nigrosine and 4 parts by weight of a low molecular weight polypropylene. Good results were obtained.

EXAMPLE 32

A developer of the black powder of Example 31 and the magnetic particles of Example 23 were mixed at a ratio of 43:57 to prepare a developer. By use of the developer, the procedure of Example 23 was repeated in substantially the same manner. As the result, although the image density was slightly lower, good images substantially free from image disturbance were obtained.

EXAMPLE 33

When an experiment was conducted according to substantially the same procedure as in Example 23 except for using fine silica particles synthesized by the wet process with a BET specific surface area of 85 $m^2/g$ treated with 5 wt. % vinyl-triethoxysilane in place of the fine silica particles of Example 23, good results were obtained.

I claim:

1. A process for developing a latent image with a developer, comprising:

charging an electrophotographic photosensitive member by negative corona charging;

irradiating the charged electrophotographic photosensitive member with light in order to form a latent image;

forming a layer of a developer comprising a magnetic toner containing magnetic powder having a BET specific surface area between 2 to 20 $m^2/g$ on a member for supporting the developer;

bringing the electrophotographic photosensitive member holding the latent image into contact with said developer layer, the electrophotographic photosensitive member comprising a support and an organic photoconductive material having a charge-generating layer and a charge-transporting layer and having a surface hardness of 12 to 100 g;

forming a toner image on said electrophotographic photosensitive member;

transferring the toner image onto a transfer material; and cleaning the electrophotographic photosensitive member having passed through the transferring step by a blade cleaning method effected by bringing a blade into contact with the electrophotographic photosensitive member such that the load applied onto the electrophotographic photosensitive member by the blade is between 1 to 100 g/cm at a static state.

2. A proces according to claim 1, wherein the charge transporting layer comprises a charge-transporting material and a binder resin having a glass transition temeperature higher than 60° C.

3. A process according to claim 2, wherein the charge-transporting layer comprises a positive hole transporting material and a binder resin selected from the group consisting of polycarbonate, polymethacrylic esters, polyallylate, polystyrene, polyester, polysulfone, styrene-acrylonitrile copolymer and styrene-methyl methacrylate copolymer.

4. a process according to claim 1, wherein the developer has a non-magnetic inorganic fine powder with a BET specific surface area between 0.5 to 500 $m^2/g$ in addition to the magnetic toner.

5. A process according to claim 1, wherein non-magnetic inorganic fine powder is made from an inorganic material selected form the group consisting of alumina, titanium dioxide, barium titanate, magnesium titanate, calcium titanate, strontium titanate, zinc oxide, siliceous sand, clay, mica, wollastonite, diatomaceous earth, chromium oxide, cerium oxide, red iron oxide, antimony tiroxide, magnesium oxide, ziroconium oxide, barium sulfate, barium carbonate, calcium carbonate and silica.

6. A process according to claim 5, wherein the non-magnetic inorganic fine powder is fine silica particles.

7. A process according to claim 6, wherein the fine silica particles are added to the developer in an amount between 0.1 to 3 weight %.

8. A process according to claim 1, wherein the magnetic toner contains between 10 to 70 weight % of the magnetic powder.

9. A process according to claim 1, wherein the blade is made of a polyurethane rubber.

10. A process according to claim 9, wherein the blade is made of a polyurethane rubber having a JIS rubber hardness between 50 to 90.

11. A process according to claim 1, wherein the magnetic toner and the electrophotographic photosensitive member satisfy the formula: $0.2 \leqq W/H \leqq 6.0$, wherein W is weight % of magnetic powder in the magnetic toner and H is a hardness of the electrophotographic photosensitive member surface.

12. A process according to claim 1, wherein the magnetic powder and the electrophotographic photosensitive member satisfy the formula: $30 \leqq S \times H \leqq 600$, wherein S is the BET specific surface area of the magnetic powder and H is a hardness of the electrophotographic photosensitive member surface.

13. A process for developing a latent image with a developer, comprising:

charging an electrophotographic photosensitive member by negative corona charging;

irradiating the charge electrophotographic photosensitve member with light in order to form a latent image;

forming a layer of a developer comprising magnetic particles containing a binder and magnetic powder having a BET specific surface area between 2 to 20 $m^2/g$, and a non-magnetic or magnetic toner on a member for supporting the developer;

bringing the electrophotographic photosensitive member holding the latent image into contact with said developer layer, the electrophotographic photosensitive member comprising a support, and an organic photoconductive material having a charge-generating layer and a charge-transporting layer and having a surface hardness of 12 to 100 g;

forming a toner image on said electrophotographic photosenitive member;

transferring the toner image onto a transfer material; and cleaning the electrophotographic photosensitive member having passed through the transferring step by a blade cleaning method effected by bringing a blade into contact with the electrophotographic photosensitive member such that the load applied onto the electrophotographic photosensitive member by the blade is between 1 to 100 g/cm at a static state.

14. A process according to claim 13, wherein the charge-transporting layer comprises a charge-transporting material and a binder resin having a glass transition temperature higher than 60° C.

15. A process according to claim 14, wherein the charge-transporting layer comprises a positive hole transporting material and a binder resin selected from the group consisting of polycarbonate, polymethacrylic esters, polyallylate, polystyrene, polyester, polysulfone, styrene-acylonitrile copolymer and sytrene-methyl methacrylate copolymer.

16. A process according to claim 13, wherein the developer has non-magnetic inorganic fine powder with a BET specific surface area between 0.5 to 500 $m^2/g$ in addition to the magnetic particles and the non-magnetic or magnetic toner.

17. A process according to claim 13, wherein the non-magnetic inorganic fine powder is made from an inorganic material selected from the group consisting of alumina, titanium dioxide, barium titanate, magnesium titanate, calcium titanate, strontium titanate, zinc oxide, siliceous sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate and silica.

18. A process according to claim 17, wherein the non-magnetic inorganic fine powder is fine silica particles.

19. A process according to claim 18, wherein the fine silica particles are added to the developer in an amount between 0.1 to 3 weight %.

20. A process according to claim 13, wherein the magnetic particles contain between 10 to 80 weight % of the magnetic powder.

21. A process according to claim 13, wherein the blade is made of a polyurethane rubber.

22. A process according to claim 21, wherein the blade is made of a polyurethane rubber having a JIS rubber hardness between 50 to 90.

23. A process according to claim 13, wherein the magnetic particles and the electrophotographic photosensitive member satisfy the formula: $0.2 \leqq W/H \leqq 6.0$, wherein W is weight % of magnetic powder in the magnetic toner and H is a hardness of the electrophotographic photosensitive member surface.

24. A process according to claim 13, wherein the magnetic powder and the electrophotographic photosensitive member satisfy the formula: $30 \leqq W/H \leqq 600$, wherein S is the BET specific surface area of the magnetic powder and H is a hardness of the electrophotographic photosensitive member surface.

25. The process for developing a latent image with a developer according to claim 1 including the step of forming a layer of a developer comprising a magnetic toner having a volume resistivity of $10^{12}$ ohm cm or more on a member for supporting the developer, in which the magnetic toner contains 10 to 70 weight % of a magnetic powder having a BET specific surface area between 2 to 20 $m^2/g$.

26. A process according to claim 1, wherein latent image is developed while applying a bias voltage between the electrophotographic photosensitive member and the member for supporting the developer.

27. A process according to claim 13, wherein the latent image is developed while applying a bias voltage between the electrophotographic photosensitive member and the member for supporting the developer.

* * * * *

UNITED STATES PATENT AND TRADEMARK OFFICE

CERTIFICATE OF CORRECTION

PATENT NO. : 4,699,865

DATED : October 13, 1987

INVENTOR(S) : YASUO MITSUHASHI

It is certified that error appears in the above-identified patent and that said Letters Patent is hereby corrected as shown below:

AT [56] IN THE REFERENCES

"Fitzpatrick, Cella, Herper & Scinto" should read --Fitzpatrick, Cella, Harper & Scinto--.

COLUMN 11

Line 26, "0.2<W/H<6.0," should read --0.2≦W/H≦6.0,--.
Line 27, "0.5<W/H<5.0," should read --0.5≦W/H≦5.0,--.
Line 38, "30<S·H<600," should read --30≦S·H≦600,--.
Line 38, "40<S·H<360." should read --40≦S·H≦360.--.

COLUMN 13

Line 63, "hardness" (second occurrence) should read --member--.

COLUMN 14

Line 12, "($\overline{m}$w)" should read --($\overline{M}$w)--.

COLUMN 15

Line 15, "on" should read --On--.

COLUMN 16

Line 45, "hardness" (second occurrence) should read --member--.

UNITED STATES PATENT AND TRADEMARK OFFICE

CERTIFICATE OF CORRECTION

PATENT NO. : 4,699,865

DATED : October 13, 1987

INVENTOR(S) : YASUO MITSUHASHI

It is certified that error appears in the above-identified patent and that said Letters Patent is hereby corrected as shown below:

COLUMN 19

Line 22, "hardness" (second occurrence) should read --member--.

COLUMN 21

Line 1, "proces" should read --process--.
Line 1, "charge" should read --charge---.
Lines 3-4, "temeperature" should read --temperature--.
Line 12, "a process" should read --A process--.
Line 16, "wherein" should read --wherein the--.
Line 18, "form" should read --from--.
Line 23, "tiroxide," should read --trioxide,--.
Line 23, "ziroconium" should read --zirconium--.
Line 56, "charge" should read --charged--.
Lines 56-67, "photosensitve" should read --photosensitive--.

UNITED STATES PATENT AND TRADEMARK OFFICE

CERTIFICATE OF CORRECTION

PATENT NO. : 4,699,865

DATED : October 13, 1987

INVENTOR(S) : YASUO MITSUHASHI

It is certified that error appears in the above-identified patent and that said Letters Patent is hereby corrected as shown below:

COLUMN 22

Line 4, "photosenitive" should read --photosensitive--.
Line 27, "has" should read --has a--.
Line 63, "$30 \leqslant W/H \leqslant 600$," should read --$30 \leqslant S \times H \leqslant 600$,--.

COLUMN 23

Line 2, "$10^{12}$ ohm cm" should read --$10^{12}$ ohm·cm--.
Line 7, "latent" should read --the latent--.

Signed and Sealed this

Twenty-first Day of June, 1988

*Attest:*

DONALD J. QUIGG

*Attesting Officer*

*Commissioner of Patents and Trademarks*